US012453912B2

(12) United States Patent
Sun et al.

(10) Patent No.: US 12,453,912 B2
(45) Date of Patent: Oct. 28, 2025

(54) CLIMBING MACHINE

(71) Applicant: Pandao Intelligent Technology (Suzhou) Co., Ltd., Suzhou (CN)

(72) Inventors: Dengyuan Sun, Suzhou (CN); Wei Zhou, Suzhou (CN); Aoqiong Zhang, Suzhou (CN)

(73) Assignee: Pandao Intelligent Technology (Suzhou) Co., Ltd., Suzhou (CN)

( * ) Notice: Subject to any disclaimer, the term of this patent is extended or adjusted under 35 U.S.C. 154(b) by 350 days.

(21) Appl. No.: 17/801,200

(22) PCT Filed: Dec. 9, 2020

(86) PCT No.: PCT/CN2020/134738
§ 371 (c)(1),
(2) Date: Aug. 19, 2022

(87) PCT Pub. No.: WO2021/164384
PCT Pub. Date: Aug. 26, 2021

(65) Prior Publication Data

US 2022/0395735 A1 Dec. 15, 2022

(30) Foreign Application Priority Data

Feb. 20, 2020 (CN) ..... 202010104697.2

(51) Int. Cl.
*A63B 69/00* (2006.01)
*A63B 23/035* (2006.01)

(52) U.S. Cl.
CPC .... *A63B 69/0048* (2013.01); *A63B 23/03575* (2013.01)

(58) Field of Classification Search
CPC ..... A63B 69/0048; A63B 23/03575; A63B 21/0056; A63B 21/0058; A63B 21/154;
(Continued)

(56) References Cited

U.S. PATENT DOCUMENTS 3,381,958 A * 5/1968 Gulland ..... A63B 22/205 482/37
5,169,361 A * 12/1992 Hsu ..... A63B 22/205 482/53

(Continued)

*Primary Examiner* — Andrew M Kobylarz
(74) *Attorney, Agent, or Firm* — David R. Stevens; Stevens Law Group

(57) ABSTRACT

Disclosed is a climbing machine including a rotatable rotation shaft (501), a plurality of one-way components (502) capable of achieving one-way transmission, a plurality of transmission units (503) and a plurality of climbing points (300, 400), where the one-way components (502) are connected to the rotation shaft (501) in a sleeving manner, each transmission unit (503) is connected to one climbing point (300, 400), and each transmission unit (503) and the rotation shaft (501) form one-way transmission by means of being connected to one one-way component (502); in one rotating direction, the rotation shaft (501) and the transmission units (503) are capable of being in transmission, and the climbing points (300, 400) descend during transmission; and in the direction opposite to the rotating direction, transmission between the rotation shaft (501) and the transmission units (503) cannot be achieved. By using the climbing machine, a user can experience a vivid feeling of climbing upwards, thereby improving the climbing experience.

12 Claims, 8 Drawing Sheets

(58) Field of Classification Search
CPC ..... A63B 21/157; A63B 22/0005; A63B 22/0012; A63B 22/205; A63B 69/00; A63B 9/00; A63B 22/04
See application file for complete search history.

(56) References Cited

U.S. PATENT DOCUMENTS

| | | | | | |
|---|---|---|---|---|---|
| 5,256,117 | A * | 10/1993 | Potts | A63B 21/157 | 482/52 |
| 6,821,232 | B1 * | 11/2004 | Wang | A63B 22/001 | 482/52 |
| 11,077,336 | B2 * | 8/2021 | Carruthers | A63B 21/4035 | |
| 11,291,882 | B2 * | 4/2022 | Carruthers | A63B 22/04 | |
| 2020/0171346 | A1 * | 6/2020 | Chen | A63B 22/205 | |
| 2022/0395735 | A1 * | 12/2022 | Sun | A63B 22/0005 | |
| 2023/0001269 | A1 * | 1/2023 | Wu | A63B 27/00 | |

* cited by examiner

A-A'

CLIMBING MACHINE

TECHNICAL FIELD

The present application relates to the field of exercise equipment, and in particular, to a climbing machine.

BACKGROUND

Rock climbing is a sport that has evolved from mountaineering. Rock climbing is a full-body exercise. The simultaneous coordination of hands, feet, eyes, among others in movements can strengthen the muscles of the whole body in a balanced manner. The sport also consumes high energy and can burn a lot of calories within a short period of time to achieve fast fitness.

An existing climbing machine uses resistance, for example, fluid resistance such as wind resistance or water resistance or some form of magnetic resistance. Resistance is used to simulate the feeling of climbing, which, however, is completely different from the real feeling of climbing. Four points in the existing climbing machine are usually relatively fixed two by two. That is, the positions of the hand and foot on the same side remain unchanged relatively, rising and lowering simultaneously. As one side of the climbing machine rises, the other side lowers. This manner is similar to that of a seesaw, and the climbing experience is very poor.

SUMMARY OF THE INVENTION

According to an aspect of the present application, a climbing machine is provided, thereby improving the climbing experience.

A climbing machine includes a rotatable rotation shaft, a plurality of one-way components capable of achieving one-way transmission, a plurality of transmission units and a plurality of climbing points, where the one-way components are connected to the rotation shaft in a sleeving manner, each transmission unit is connected to one climbing point, and each transmission unit and the rotation shaft form one-way transmission by means of being connected to one one-way component; in one rotating direction, the rotation shaft and the transmission units are capable of being in transmission, and the climbing points descend during transmission; and in the direction opposite to the rotating direction, transmission between the rotation shaft and the transmission units is not capable of being achieved.

The beneficial effects of the implementation are as follows: Each climbing point corresponds to one transmission unit and one-way component, so that climbing points can move independently, thereby enriching the climbing form and improving the climbing experience. If a rotation shaft is controlled to rotate slowly, when the hands or feet of a user naturally fall on the climbing points, the hands or feet can lower along with the climbing points. When the user lifts the hands or feet, through the characteristic of one-way transmission, corresponding climbing points can move upward, to provide the user with realistic feeling of climbing, thereby improving the climbing experience. During climbing, a climber climbs against the gravity, thereby improving the climbing experience for the user.

In some implementations, upper guiderails are arranged on two sides of the vertical frame respectively, lower guiderails are further arranged on the two sides of the vertical frame respectively, each upper guiderail is slidably connected to one climbing point, each lower guiderail is slidably connected to one climbing point, the climbing point slidably connected to the upper guiderail is a handle, and the climbing point slidably connected to the lower guiderail is a pedal. In this implementation, the pedal is provided for a user to step on, and the handle is provided for a user to hold. The user can move both hands and feet. Further, if the climbing machine has two or more parallel vertical frames and each frame is provided with two pedals and two handles, the climbing machine allows two or more people to climb at the same time.

In some implementations, the pedal includes a foot pedal portion and a foot surface portion. A user puts a foot on the foot pedal portion, and the foot surface portion covers the foot surface of the user. When the user lifts the foot, the pedal can be driven to move upward.

In some implementations, the one-way component includes a first component and a second component coaxial with the first component, and the first component is rotatable relative to the second component in one direction and is locked relative to the second component in the opposite direction.

In some implementations, the one-way component is a one-way bearing, a one-way clutch or a ratchet wheel.

In some implementations, each transmission unit includes two transmission members and one closed transfer member, two ends of the transfer member are sleeved on the transmission members, one transmission member is connected to the one-way component in a sleeving manner, and the climbing point is connected to the transfer member. Through the movement of the transmission unit, the climbing points are driven to move up and down.

In some implementations, each transmission unit includes two transmission members and one closed transfer member, two ends of the transfer member are sleeved on the transmission members, the climbing point is connected to the transfer member, the transfer member is a chain, the transmission members are gears, a gear is arranged on an outer periphery of the one-way component, and the one-way component is adjacent to an outer edge of the transfer member and is engaged with the transfer member.

In some implementations, each transmission unit includes two transmission members and one closed transfer member, two ends of the transfer member are sleeved on the transmission members, the climbing point is connected to the transfer member, one transmission member of each transmission unit is connected to a second rotation shaft in a sleeving manner, a second transmission member is further connected to the second rotation shaft in a sleeving manner, each second transmission member is connected to one end of a closed second transfer member, the other end of each second transfer member is connected to one second transmission member, and the second transmission member arranged at the other end of the second transfer member is connected to an outer periphery of the one-way component in a sleeving manner.

In some implementations, each transmission unit includes two transmission members and one closed transfer member, two ends of the transfer member are sleeved on the transmission members, the climbing point is connected to the transfer member, the transfer member is a chain, the transmission members are gears, a gear is arranged on an outer periphery of the one-way component, and the one-way component is adjacent to an inner edge of the transfer member and is engaged with the transfer member.

In some implementations, each transmission unit includes a transmission member, a transfer member and a rack, the transfer member is wound around the transmission member, one end of the transfer member is connected to an upper end of the rack, the other end of the transfer member is connected to the climbing point, a gear is arranged at an outer periphery of the one-way component, and the gear is engaged with the rack.

In some implementations, the transmission members are gears, and the transfer member is a chain; or the transmission members are pulleys, and the transfer member is a belt; or the transmission members are sheaves, and the transfer member is a steel rope.

In some implementations, the rotation shaft is transversely arranged in the middle of the vertical frame in a rotatable manner and extends from a left side and a right side of the vertical frame, two one-way components are arranged on the left side of the vertical frame, two one-way components are also arranged on the right side of the vertical frame, two transmission units respectively extend upwards from the rotation shaft along the vertical frame on the two sides of the vertical frame, and other two transmission units respectively extend downwards from the rotation shaft along the vertical frame on the two sides of the vertical frame. Each vertical frame is correspondingly provided with four climbing points. Two climbing points may be used as handles and the other two climbing points may be used as pedals for a single person to climb with hands and feet.

In some implementations, the transmission member is connected to the one-way component by a key, the key includes a body, the body has a first side surface and a second side surface opposite to the first side surface, a first limiting portion and a second limiting portion are arranged at two ends of the first side surface, a third limiting portion and a threaded hole arranged spaced apart from the third limiting portion are arranged on the second side surface, an axial key slot is arranged at an inner edge of the transmission member connected to the one-way component in a sleeving manner, the key slot receives the body, the first side surface faces the one-way component, an outer edge of the one-way component is limited between the first limiting portion and the second limiting portion, a bolt is arranged in the threaded hole, and the inner edge of the transmission member is limited between the bolt and the third limiting portion.

In some implementations, the drive unit includes a motor, a reducer and a transmission assembly, one end of the transmission assembly is connected to an output shaft of the reducer, the other end is connected to the rotation shaft, and the drive unit is used for driving the rotation shaft to rotate. This implementation provides a powered climbing machine. A user uses the drive unit to drive the rotation shaft to rotate. In this case, the rotation shaft transfers torque to the transmission unit through the one-way component, and the transmission unit drives a climbing point to lower slowly.

In some implementations, the climbing machine includes a damping device used for reducing the rotational speed of the rotation shaft. This implementation provides an unpowered climbing machine.

DETAILED DESCRIPTION

Figure 1:
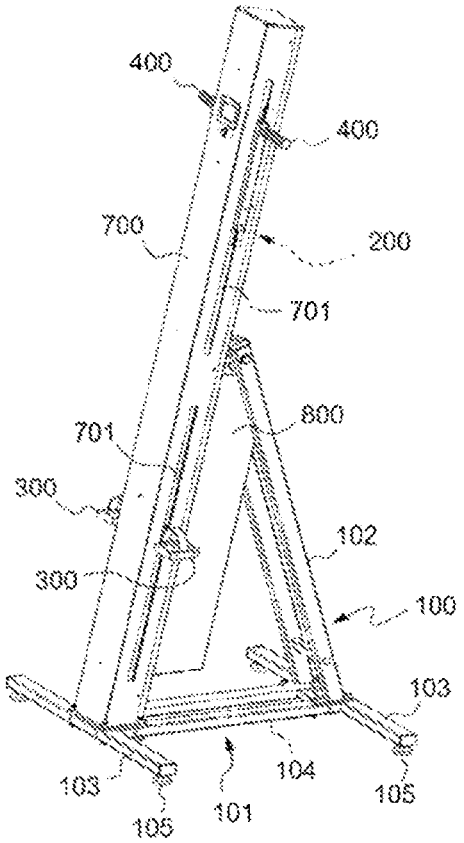
FIG. 1 is a schematic diagram of a climbing machine according to a specific embodiment of the present disclosure.

The present application is further described below in detail with reference to the accompanying drawings.

Referring to FIG. 1, FIG. 3, FIG. 5, and FIG. 11 to FIG. 14, in various embodiments provided in the present application, a climbing machine including a rotatable rotation shaft 501, a plurality of one-way components 502 capable of achieving one-way transmission, a plurality of transmission units 503 and a plurality of climbing points 300, 400, where the one-way components 502 are connected to the rotation shaft 501 in a sleeving manner, each transmission unit 503 is connected to one climbing point 300, 400, and each transmission unit 503 and the rotation shaft 501 form one-way transmission by means of being connected to one one-way component 502; in one rotating direction, the transmission units 503 and the rotation shaft 501 are capable of being in transmission, and the climbing points 300, 400 descend during transmission; and in the direction opposite to the rotating direction, transmission between the transmission units 503 and the rotation shaft 501 cannot be achieved.

Figure 3:
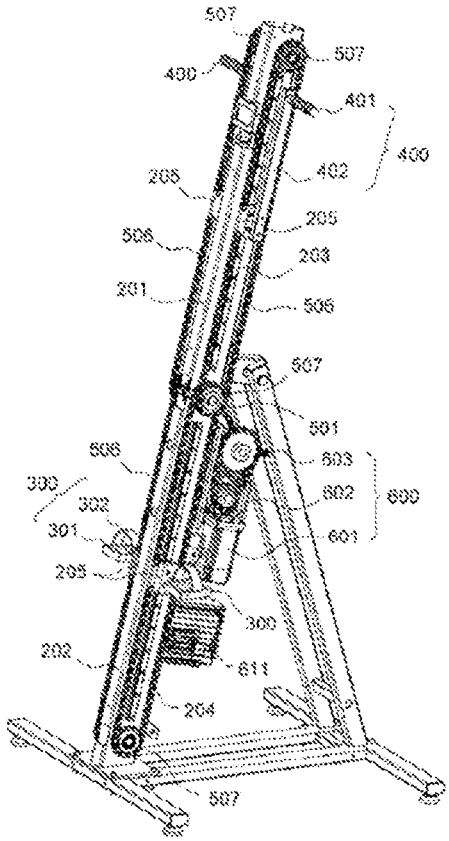
FIG. 3 is a schematic diagram of the climbing machine in FIG. 1 with a housing hidden.
Figure 5:
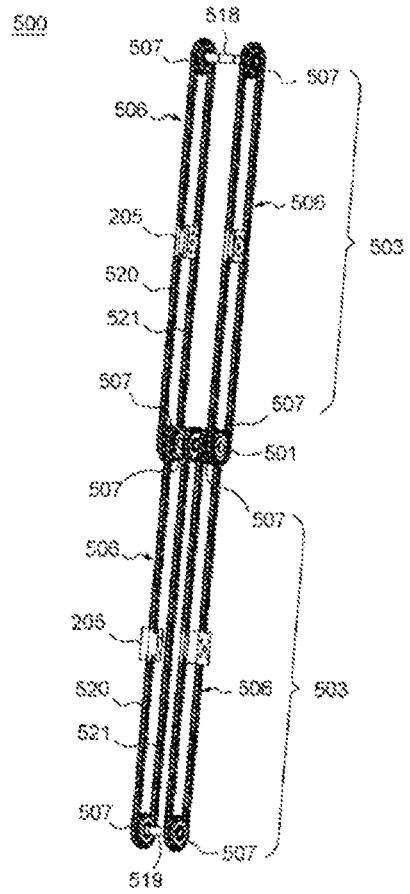
FIG. 5 is a schematic diagram of a one-way transmission mechanism of the climbing machine in FIG. 3.

In some specific embodiments, referring to FIG. 1, FIG. 3, and FIG. 5, the climbing machine includes a support 100, a vertical frame 200, two pedals 300 for a user to step on, two handles 400 for a user to hold, a one-way transmission mechanism 500, and a drive unit 600. In these embodiments, the pedals 300 and the handles 400 are all the climbing points. The two pedals 300 and the two handles 400 can respectively move up and down independently. The drive unit 600 can continuously drive the one-way transmission mechanism 500 to run in one direction to drive the two pedals 300 and the two handles 400 to move downward. When any pedal 300 or any handle 400 applies an upward force, the pedal 300 or handle 400 under the action of the force can move upward. In these embodiments, both the hands and feet of a user can be exercised.

In some other embodiments, a quantity of the climbing points 300, 400 is not limited to 4. For example, the climbing points only include the pedals 300 but do not include the handles 400 or the handles 400 cannot slide up and down. Alternatively, the climbing points only include the handles 400 but do not include the pedals 300. In these implementations, a user does climb training with only hands or feet.

In the embodiment shown in FIG. 1, the vertical frame 200 is vertically arranged on the support 100 and tilts in a direction away from a user. The support 100 supports the vertical frame 200 to allow the vertical frame 200 to carry the weight of a human. The support 100 includes one base 101 and one inclined strut 102. The base 101 includes two parallel support rods 103 and two connecting rods 104 arranged between the two support rods 103. A support leg 105 is arranged at the bottom of each of two ends of each support rod 103. The support legs 105 are placed on the ground to support the climbing machine. A lower end of the vertical frame 200 is connected to the base 101. The inclined strut 102 is obliquely arranged behind the vertical frame 200. One end of the inclined strut 102 is connected to the middle of the vertical frame 200, and the other end is connected to the base 101, so that the vertical frame 200, the base 101, and the inclined strut 102 form a stable triangular structure.

Figure 2:
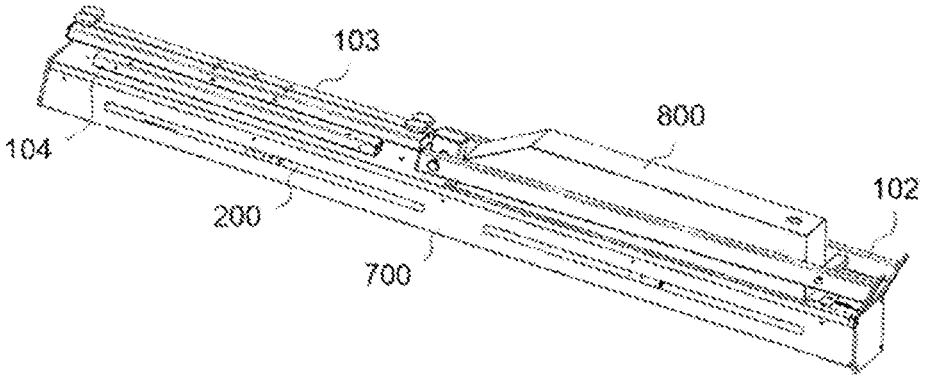
FIG. 2 is a schematic diagram of the climbing machine in FIG. 1 being folded.

In the embodiment shown in FIG. 1, further, the lower end of the vertical frame 200 is detachably connected to both the connecting rod 104 and one support rod 103. A lower end of the support rod 103 is detachably connected to both the connecting rod 104 and the other support rod 103. The inclined strut 102 is hinged to the vertical frame 200. The detachable connection includes, but not limited to, a bolt-nut connection. The benefit of this preferred embodiment is that the space occupied to pack and store the climbing machine is reduced. Specifically, the vertical frame 200, the inclined strut 102, and the support rod 103 are detached from the connecting rod 104, and then the inclined strut 102 is rotated to fold the inclined strut 102 and the vertical frame 200. The vertical frame 200, the inclined strut 102, the support rod 103, and the connecting rod 104 are placed in the same direction, to form the state in FIG. 2.

In the embodiment shown in FIG. 1, further, a first housing 700 is arranged outside the vertical frame 200. The first housing 700 covers the one-way transmission mechanism 500. A second housing 800 is arranged behind the vertical frame 200. The second housing 800 covers the drive unit 600. The first housing 700 and the second housing 800 can provide protection, to prevent the one-way transmission mechanism 500 and the drive unit 600 from being exposed to avoid injuring a user.

In some other implementations, two or more climbing machines are integrated together to form one climbing machine for use by more than person at the same time. For example, two or more vertical frames 200 are arranged in parallel. Each vertical frame 200 separately corresponds to two pedals 300, two handles 400, and one one-way transmission mechanism 500. The transmission mechanism 500 share one drive unit 600. That is, the drive unit 600 can continuously drive the one-way transmission mechanism 500 to run in one direction to drive the two pedals 300 and the two handles 400 to move downward.

In some other implementations, the support 100 is not used to support the vertical frame 200. Instead, the vertical frame 200 may be leaned against a wall body. The lower end of the vertical frame 200 is connected to the ground, an upper end of the vertical frame 200 is connected to the wall body. For example, a bolt is used for fastening.

In the embodiment shown in FIG. 3, the pedals 300 and the handles 400 are respectively slidably arranged on two sides of the vertical frame 200. Specifically, the vertical frame 200 includes an upper section 201 and a lower section 202. One upper guiderail 203 extending along the upper section 201 is arranged on each of a left side and a right side of the upper section 201. One lower guiderail 204 extending along the lower section 202 is respectively arranged on each of a left side and a right side of the lower section 202. The two pedals 300 are respectively connected to one slider 205. The two sliders 205 are respectively slidably connected to the two lower guiderails 204. The two pedals 300 are respectively vertically slidable along the lower guiderails 204. The handle 400 includes a holding portion 401 and an extending portion 402 that is connected to the holding portion 401 and extends downward. A lower end of each extending portion 402 is connected to one slider 205. The two sliders 205 are respectively slidably connected to the two upper guiderails 203. The extending portions 402 are used for increasing the height of the holding portion 401. Even if the sliders 205 connected to the handles 400 slide to lower ends of the upper guiderails 203, the holding portions 401 can still remain at heights for easy holding. Four elongated through holes 701 extending in a slide direction of the pedals 300 and the handles 400 are reserved in a left side and a right side of the first housing 700. When the first housing 700 covers the vertical frame 200, the pedals 300 and the handles 400 are located outside the first housing 700. The sliders 205 are located inside the first housing 700. The length of the through hole 701 limits a slide stroke of the slider 205.

In the embodiment shown in FIG. 3, the pedal 300 includes a foot pedal portion 301 and a foot surface portion 302 connected to the foot pedal portion 301. During the use of the climbing machine, the foot of a user steps on the foot pedal portion 301, and the foot surface portion 302 covers the foot surface of the user. When the user lifts the foot, the pedal 300 can be driven to move upward. The two pedals 300 and the two handles 400 are further connected to the one-way transmission mechanism 500. Under the drive of the drive unit 600, the one-way transmission mechanism 500 can drive the pedals 300 and the handles 400 to move downward.

Figure 4:
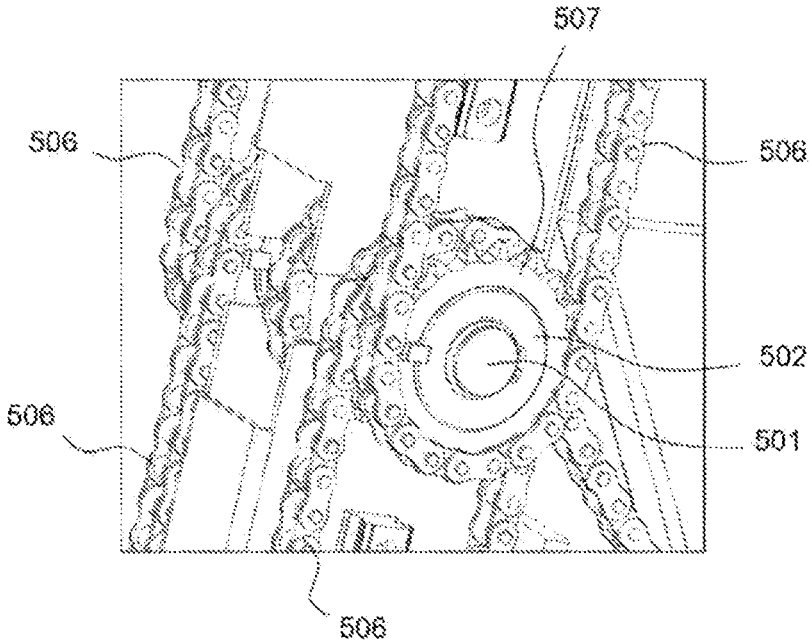
FIG. 4 is a partial enlarged view of the position of a rotation shaft of the climbing machine in FIG. 3.

In the embodiments shown in FIG. 3 to FIG. 5, the one-way transmission mechanism 500 includes a rotatable rotation shaft 501, four one-way components 502 connected to the rotation shaft 501 in a sleeving manner, and four transmission units 503 connected to the one-way components 502.

In the embodiments shown in FIG. 3 to FIG. 5, the rotation shaft 501 is transversely arranged in the middle of the vertical frame 200, that is, between the upper section 201 and the lower section 202 of the vertical frame 200, and extends from a left side and a right side of the vertical frame 200. The rotation shaft 501 receives toque from the drive unit 600 to rotate around a central axis of the rotation shaft 501. For example, further referring to FIG. 6 and FIG. 7, two ball bearings 504 are connected to the rotation shaft 501 in a sleeving manner. The ball bearings 504 are connected to two fixing bases 505. The fixing bases 505 are fixedly connected to the vertical frame 200, to make the rotation shaft 501 rotatable.

Figure 10:
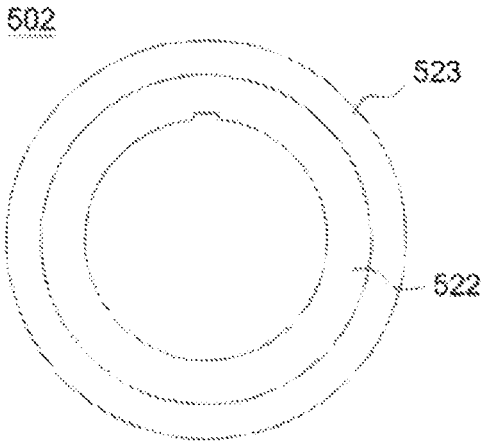
FIG. 10 is a schematic structural diagram of a one-way component according to a specific embodiment of the present disclosure.

In the embodiments shown in FIG. 3 to FIG. 7, two one-way components 502 are arranged on the left side of the vertical frame 200, and the other two one-way components 502 are arranged on the right side of the vertical frame 200. The one-way component 502 is a component capable of one-way transmission. Referring to FIG. 10, the one-way component 502 includes a first component 522 and a first component 523 arranged coaxial with the first component 522, and the first component 522 is rotatable relative to the first component 523 in one direction and is locked relative to the first component 523 in the opposite direction. For example, the one-way component 502 may be a one-way bearing, a one-way clutch or a ratchet wheel.

Figure 6:
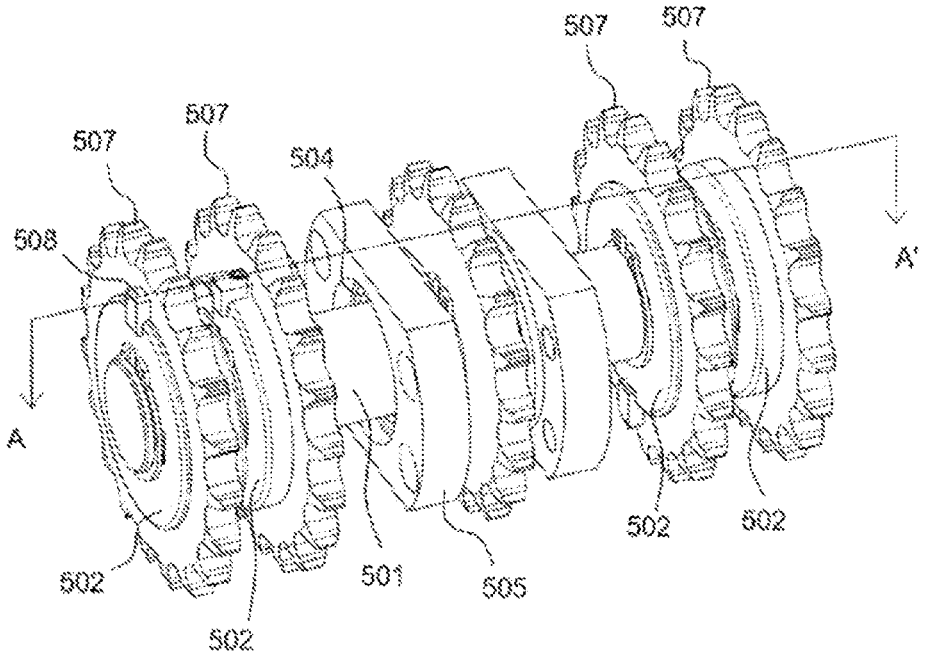
FIG. 6 is an assembled view of a rotation shaft, a gear, and a one-way component of the climbing machine in FIG. 3.
Figure 7:
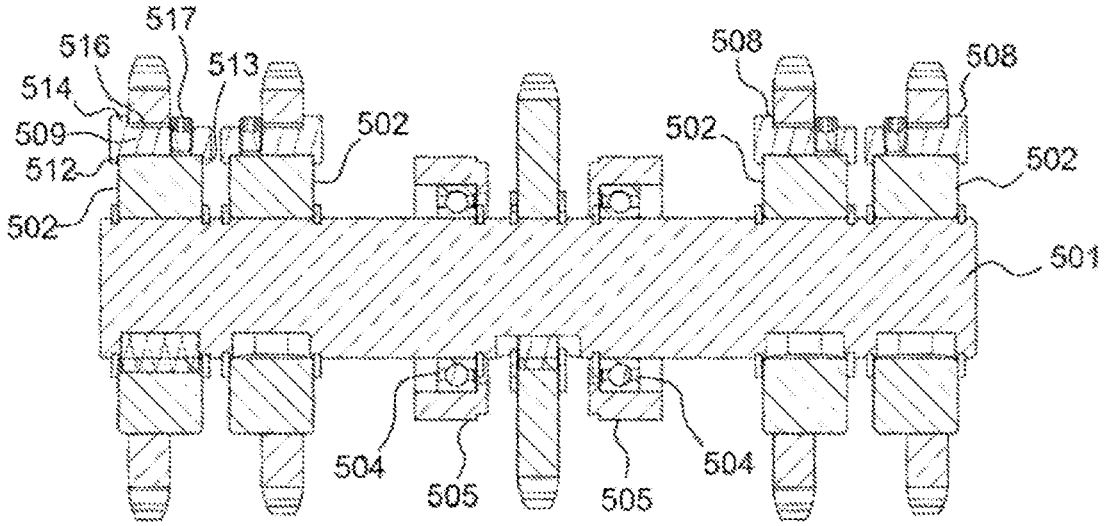
FIG. 7 is a cross-sectional view along AN in FIG. 6.
Figure 8:
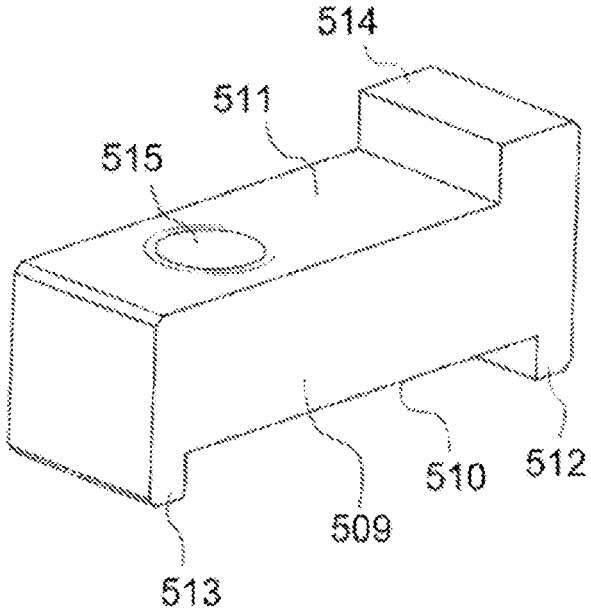
FIG. 8 is a schematic diagram of a key according to a specific embodiment of the present disclosure.

In some implementations, the transmission unit 503 includes a closed transfer member 506 and two transmission members 507. In the embodiment shown in FIG. 5, the transmission unit 503 is a sprocket transmission mechanism. That is, the transmission members 507 are gears 507, and the transfer member 506 is a chain 506. Each transmission unit 503 includes a closed chain 506 and two gears 507 respectively engaged at two ends of the chain 506. One gear 507 is connected to the one-way component 502. One gear 507 is arranged at an outer periphery of each of the four one-way components 502. The one-way component 502 transfers torque to the gear 507 in a single direction. A one-way bearing is used as an example. The gear 507 is sleeved on an outer periphery of an outer ring of the one-way bearing and is connected using a key 508. Referring to FIG. 6 to FIG. 8, the key 508 includes a cuboidal body 509. The body 509 has a first side surface 510 and a second side surface 511 opposite to the first side surface 510. A first limiting portion 512 and a second limiting portion 513 are arranged at two ends of the first side surface 510. A third limiting portion 514 and a threaded hole 515 arranged spaced apart from the third limiting portion 514 are arranged on the second side surface 511. An axial key slot 516 is arranged at an inner edge of a gear 507 connected to the one-way bearing in a sleeving manner. In a structure connecting the gear 507 and the one-way bearing, the first side surface 510 faces the one-way bearing. An outer edge of the one-way bearing is accommodated between the first limiting portion 512 and the second limiting portion 513 to limit the axial movement of the key 508. The body 509 is arranged in the key slot 516. A bolt 517 is arranged in the threaded hole 515. The inner edge of the gear 507 is accommodated between the bolt 517 and the third limiting portion 514 to limit the axial movement of the gear 507.

Continuing to refer to FIG. 5, the transmission unit 503 extends in an extension direction of the vertical frame 200. Two transmission units 503 are respectively arranged on the left side and the right side of the upper section 201 of the vertical frame 200. The other two transmission units 503 are respectively arranged on the left side and the right side of the lower section 202 of the vertical frame 200. Specifically, one rotatable gear 507 is arranged on each of two sides of the top of the upper section 201. For example, the two gears 507 are respectively rotatably connected by a ball bearing to a first transverse shaft 518 transversely fastened at the top of the upper section 201. One chain 506 extending in an extension direction of the upper section 201 is further arranged on each of two sides of the upper section 201. An upper end of each chain 506 is engaged with the gear 507 arranged at the top of the upper section 201 and on the same side as the chain 506. A lower end of the chain 506 is engaged with the gear 507 on an outer periphery of the one-way component 502 on the same side. One rotatable gear 507 is arranged on each of two sides of the bottom of the lower section 202. For example, the two gears 507 are respectively rotatably connected by a ball bearing to a second transverse shaft 519 transversely fastened at the bottom of the lower section 202. One chain 506 extending in an extension direction of the lower section 202 is arranged on each of two sides of the lower section 202. A lower end of the chain 506 is engaged with the gear 507 arranged at the bottom of the lower section 202 and on the same side as the chain 506. An upper end of the chain 506 is engaged with the gear 507 on the outer periphery of the one-way component 502 on the same side.

In some other implementations, a pulley transmission structure may be used in place of the transmission unit 503 in the sprocket transmission in the embodiment shown in FIG. 5. For example, the transmission unit 503 includes a closed belt and transmission rollers connected at two ends of the belt.

In some other implementations, a sheave transmission unit may be used in place of the transmission unit 503 in the sprocket transmission in the embodiment shown in FIG. 5. For example, the transmission unit 503 includes a closed steel rope and transmission rollers connected at two ends of the steel rope.

The slider 205 is fastened on the chain 506. The working principle of the one-way transmission mechanism 500 is described by using a one-way bearing as an example. In the embodiment shown in FIG. 5, each closed chain 506 includes a front section 520 slightly close to a user and a rear section 521 slightly far away from the user. The slider 205 is fastened on the front section 520. The drive unit 600 inputs torque into the rotation shaft 501, to make the rotation shaft 501 rotate counterclockwise. In this case, an inner ring and an outer ring of the one-way bearing are locked. Therefore, the one-way bearing drives the gear 507 to rotate counterclockwise, to make the chain 506 rotate counterclockwise, thereby driving the slider 205 to move downward. That is, the pedal 300 and the handle 400 connected to the slider 205 also move downward. When an upward force is applied to any pedal 300 or handle 400, an outer ring and an inner ring of a one-way bearing corresponding to the pedal 300 or the handle 400 are rotatable relative to each other. Therefore, the pedal 300 or the handle 400 can be lifted. In other implementations, the slider 205 may be connected to the rear section 521. In this case, the rotation shaft 501 should rotate clockwise, and the one-way bearing is configured to drive the gear 507 to rotate clockwise.

Figure 11:
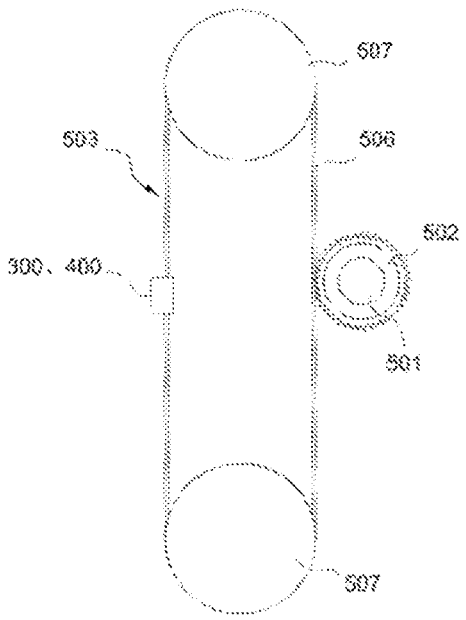
FIG. 11 is a schematic diagram of a connection between a transmission unit and a one-way component according to a specific embodiment of the present disclosure.

In some other implementations, referring to FIG. 11, a connection manner between the one-way component 502 and the transmission unit 503 may be that the one-way component 502 is adjacent to an outer edge of the transfer member 506 and is engaged with the transfer member 506 by a gear at the outer periphery of the one-way component 502. In these implementations, the transfer member 506 is a chain, and the transmission members 507 are gears.

Figure 12:
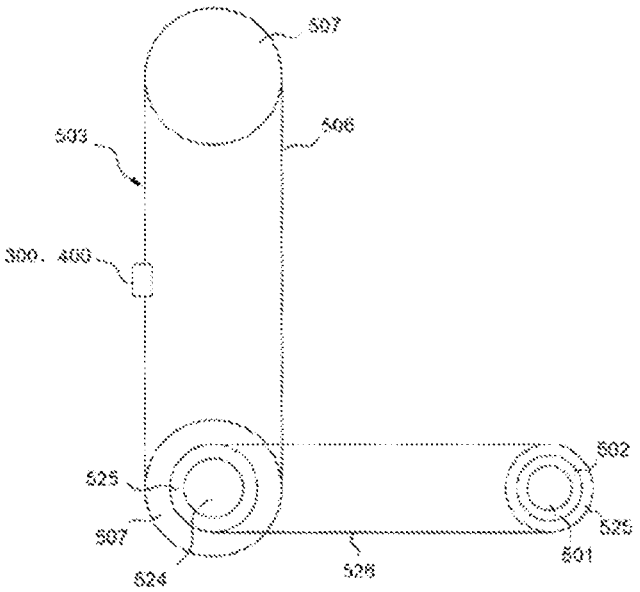
FIG. 12 is a schematic diagram of a connection between a transmission unit and a one-way component according to another specific embodiment of the present disclosure.

In some other implementations, referring to FIG. 12, the connection manner between the one-way component 502 and the transmission unit 503 may be that one transmission member 507 in each transmission unit 503 is connected to a second rotation shaft 524 in a sleeving manner, and the rotation shaft 501 is transmissively connected to the second rotation shaft 524. Specifically, a second transmission member 525 is connected to the second rotation shaft 524 in a sleeving manner. Each second transmission member 525 is respectively connected to one end of a closed second transfer member 526. The other end of each second transfer member 526 is connected to one second transmission member 525. The second transmission member 525 is connected to the outer periphery of the one-way component 502 in a sleeving manner. In these implementations, the transfer member 506 is a chain, and the transmission members 507 are gears. Alternatively, the transfer member 506 is a belt, and the transmission members 507 are belt pulleys. Alternatively, the transfer member 506 is a steel rope, and the transmission members 507 are sheaves. In these implementations, the second transfer member 526 is a chain, and the second transmission members 525 are gears. Alternatively, the second transfer member 526 is a belt, and the second transmission members 525 are belt pulleys. Alternatively, the second transfer member 526 is a steel rope, and the second transmission members 525 are sheaves.

Figure 13:
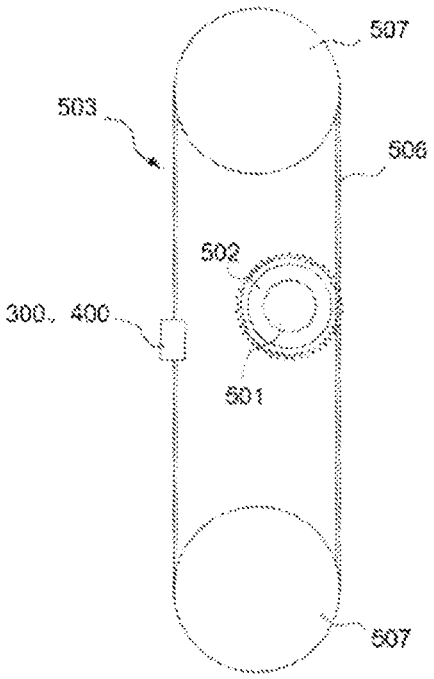
FIG. 13 is a schematic diagram of a connection between a transmission unit and a one-way component according to still another specific embodiment of the present disclosure.

In some other implementations, referring to FIG. 13, a connection manner between the one-way component 502 and the transmission unit 503 may be that the one-way component 502 is adjacent to an inner edge of the transfer member 506 and is engaged with the transfer member 506 by a gear at the outer periphery of the one-way component 502. In these implementations, the transfer member 506 is a chain, and the transmission members 507 are gears.

Figure 14:
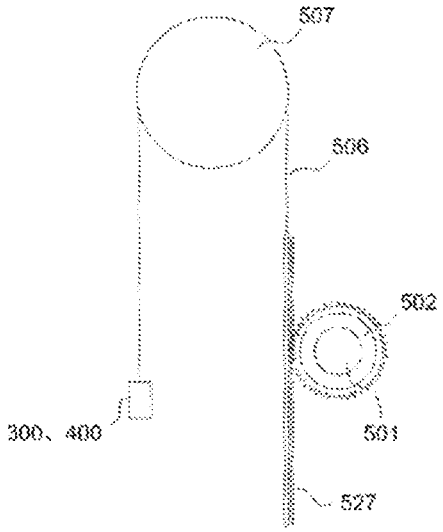
FIG. 14 is a schematic diagram of a connection between a transmission unit and a one-way component according to yet another specific embodiment of the present disclosure.

In some other implementations, referring to FIG. 14, the transmission unit 503 includes one transfer member 506, one transmission member 507, and one rack 527. The transfer member 506 may be a bendable linear element such as a steel rope, a belt or a chain. The rack 527 extends vertically. The transfer member 506 is wound around the transmission member 507, and has one end connected to an upper end of the rack 527 and the other end connected to a climbing point. The rotation shaft 501 and the one-way components 502 connected to the rotation shaft 501 in a sleeving manner are arranged behind the vertical frame 200. A gear is arranged on the outer periphery of each one-way component 502. The gear is engaged with the rack 527 to implement a connection between the transmission unit 503 and the one-way component 502. Preferably, the rack 527 and the vertical frame 200 are slidably connected by a guiderail slider, which implements guidance during the vertical movement of the rack 527.

Figure 9:
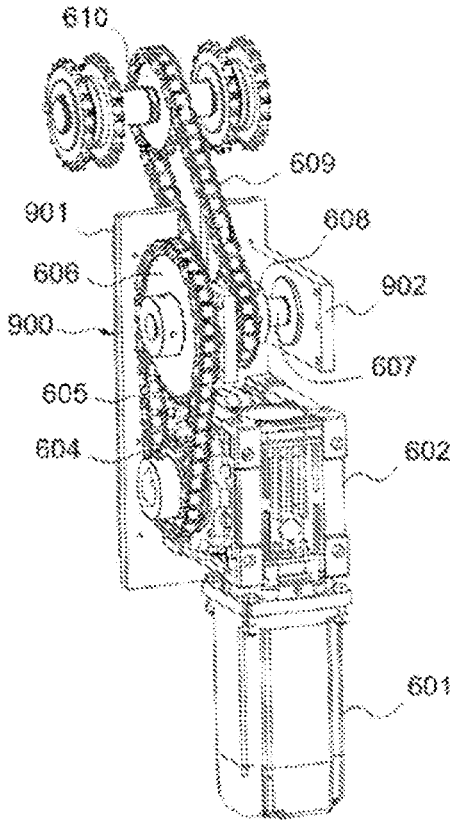
FIG. 9 is a schematic diagram of a drive unit in FIG. 3.

Referring to FIG. 3, the drive unit 600 is arranged behind the vertical frame 200 and is used for providing power for the rotation of the rotation shaft 501. The drive unit 600 includes a motor 601, a reducer 602, and a transmission assembly 603. The transmission assembly 603 is used for transferring output power of the reducer 602 to the rotation shaft 501. Referring to FIG. 9, the transmission assembly 603 includes a first gear 604, a first chain 605, a second gear 606, a third transverse shaft 607, a third gear 608, a second chain 609, and a fourth gear 610. One mounting rack 900 used for bearing the drive unit 600 is fastened behind the vertical frame 200. The mounting rack 900 includes one back board 901 fastened on a rear side of the vertical frame 200 and one pair of vertical boards 902 (only one vertical board 902 is shown in FIG. 9) that are perpendicular to the back board 901 and are parallel to a vertical plane. The third transverse shaft 607 transversely passes through the two vertical boards 902 and is rotatably connected to the vertical boards 902 by ball bearings, to make the third transverse shaft 607 rotatable. The reducer 602 is fastened on the back board 901, and the motor 601 is connected to the reducer 602. An output shaft of the reducer 602 is transversely arranged. The first gear 604 is fastened on the output shaft of the reducer 602. The second gear 606 is connected to the third transverse shaft 607 in a sleeving manner. The first gear 604 and the second gear 606 are connected by the first chain 605. The third gear 608 is connected to the third transverse shaft 607 in a sleeving manner. The fourth gear 610 is connected to the rotation shaft 501 in a sleeving manner. The third gear 608 and the fourth gear 610 are connected by the second chain 609. In some implementations, the motor 601 is a servo motor. Therefore, the drive unit 600 further includes a servo driver 611. The servo driver 611 is fastened to the rear side of the vertical frame 200, for example, arranged below the motor 601. The transmission assembly 603 is not limited to the form shown in FIG. 9. For example, a combination form of a gear and a chain may be changed. In other implementations, the transmission assembly 603 may further include a pulley mechanism, a sheave, or the like.

When the drive unit 600 is started, the one-way transmission mechanism 500 drives the two pedals 300 and the two handles 400 to move downward. When the pedals 300 and the handles 400 move to lower ends of corresponding chains 507, for example, the pedals 300 and the handles 400 lower to lower ends of corresponding through holes 701, the pedals 300 and the handles 400 are hindered and stop moving downward. During the use of the climbing machine in the present disclosure, a user uses two feet to step on the pedals 300 and use two hands to hold the handles 400. The two pedals 300 and the two handles 400 can move up and down independently, so that a plurality of climbing manners can be implemented, thereby improving the climbing experience. For example, the user may separately lift one hand or one foot, lift both hands, lift both feet, lift one hand and one foot on different sides or lift one hand and one foot on the same side. During use, the drive unit 600 provides power, and the one-way transmission mechanism 500 can drive the pedals 300 and the handles 400 to move downward. When the hands or feet of the user naturally fall on the handles 400 or the pedals 300, the hands or feet can lower along with the climbing points the handles 400 or the pedals 300. When the user lifts the hands or feet, through the characteristic of one-way transmission of the one-way transmission mechanism 500, corresponding handles 400 or pedals 300 can move upward, to provide the user with a feeling of climbing upward, thereby improving the climbing experience. During climbing, a climber climbs against the gravity, thereby improving the climbing experience for the user.

Figure 15:
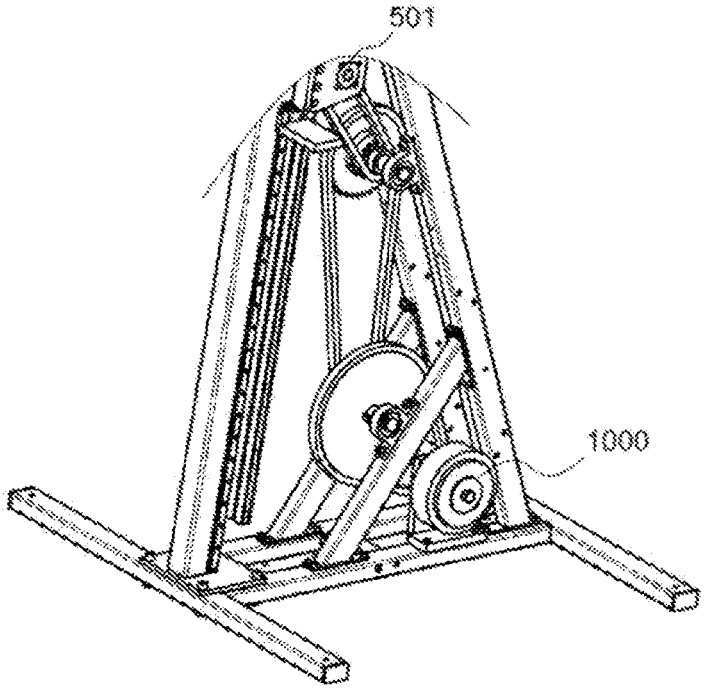
FIG. 15 is a partial schematic diagram of an unpowered climbing machine according to a specific embodiment of the present disclosure.

Disclosed in the embodiment shown in FIG. 9 is a powered climbing machine. During use, the drive unit 600 continuously provides power to the one-way transmission mechanism 500 to drive the pedals 300 and the handles 400 to lower. In some other implementations, an unpowered climbing machine is provided. Referring to FIG. 15, the unpowered climbing machine includes a damping device 1000. The damping device 1000 is arranged behind the vertical frame 200 and may be used for providing damping for the rotation of the rotation shaft 501. The damping device 1000 may be a magnetic powder brake. A conventional manner may be used between the magnetic powder brake and the rotation shaft 501 for transmission, for example, sprocket transmission. When a user touches climbing points 300, 400, for example, steps on the pedals 300 or holds the handles 400, under the weight of the body, the climbing points 300, 400 move downward. In this case, a transmissible relationship is provided between the transmission unit 503 and the one-way component 502. That is, the rotation shaft 501 is rotatable. However, under the action of the damping device 1000, the rotational speed of the rotation shaft 501 is small, so that the climbing points 300, 400 can slowly lower at a uniform speed under the weight of the body.

The foregoing descriptions are some implementation manners of the present application. It should be noted that for a person of ordinary skill in the art, several variations and improvements may further be made without departing from the concept of this application. These variations and improvements should also be deemed as falling within the scope of protection of this application.

The invention claimed is:

1. A climbing machine, comprising a rotatable rotation shaft, a plurality of one-way components capable of achieving one-way transmission, a plurality of transmission units and a plurality of climbing points, wherein the plurality of one-way components are connected to the rotatable rotation shaft in a sleeving manner, each transmission unit of the plurality of transmission units is connected to a respective climbing point of the plurality of climbing points, and each transmission unit of the plurality of transmission units and the rotatable rotation shaft form one-way transmission by means of being connected to a respective one-way component of the plurality of one-way components; in one rotating direction, the rotatable rotation shaft and the plurality of transmission units are capable of being in transmission, and the plurality of climbing points descend during transmission; and in the direction opposite to the rotating direction, transmission between the rotatable rotation shaft and the plurality of transmission units is not capable of being achieved, wherein:

the climbing machine comprises at least one vertical frame;

upper guiderails are arranged on two sides of the vertical frame respectively;

lower guiderails are further arranged on the two sides of the vertical frame respectively;

each of the upper guiderails is slidably connected to a climbing point of the plurality of climbing points;

each of the lower guiderails is slidably connected to a climbing point of the plurality of climbing points;

each of the climbing points slidably connected to the upper guiderails is a handle; and each of the climbing points slidably connected to the lower guiderails is a pedal.

2. The climbing machine according to claim 1, wherein each transmission unit of the plurality of transmission units comprises two transmission members and one closed transfer member, each end of the closed transfer member is sleeved on a respective transmission member of the two transmission members, one transmission member of the two transmission members is connected to a respective one-way component of the plurality of one-way components in a sleeving manner, and each climbing point of the plurality of climbing points is connected to a respective closed transfer member.

3. The climbing machine according to claim 2, wherein the transmission members are gears, and the closed transfer member is a chain; or the transmission members are pulleys, and the closed transfer member is a belt; or the transmission members are sheaves, and the closed transfer member is a steel rope.

4. The climbing machine according to claim 2, comprising at the least one vertical frame, wherein the rotatable rotation shaft is transversely arranged in the middle of the at least one vertical frame in a rotatable manner and extends from a left side and a right side of the at least one vertical frame, two one-way components of the plurality of one-way components are arranged on the left side of the at least one vertical frame, two one-way components of the plurality of one-way components are also arranged on the right side of the at least one vertical frame, two transmission units of the plurality of transmission units respectively extend upwards from the rotatable rotation shaft along the at least one vertical frame on the left and right sides of the at least one vertical frame, and other two transmission units of the plurality of transmission units respectively extend downwards from the rotatable rotation shaft along the at least vertical frame on the two left and right sides of the at least one vertical frame.

5. The climbing machine according to claim 2, wherein the one transmission member of the two transmission members is connected to the respective one-way component of the plurality of one-way components by a key, the key comprises a body, the body has a first side surface and a second side surface opposite to the first side surface, a first limiting portion and a second limiting portion are arranged at two ends of the first side surface, a third limiting portion and a threaded hole arranged spaced apart from the third limiting portion are arranged on the second side surface, an axial key slot is arranged at an inner edge of the one transmission member of the two transmission members, which is connected to the respective one-way component of the plurality of one-way components in a sleeving manner, the key slot receives the body, the first side surface faces the respective one-way component of the plurality of one-way components, an outer edge of the respective one-way component of the plurality of one-way components is limited between the first limiting portion and the second limiting portion, a bolt is arranged in the threaded hole, and the inner edge of the one transmission member of the two transmission members is limited between the bolt and the third limiting portion.

6. The climbing machine according to claim 1, wherein each transmission unit of the plurality of transmission units comprises two transmission members and one closed transfer member, each end of the closed transfer member is sleeved on a respective transmission member of the two transmission members, each climbing point of the plurality of climbing points is connected to a respective closed transfer member, one transmission member of each transmission unit is connected to a second rotation shaft in a sleeving manner, a second transmission member is further connected to the second rotation shaft in a sleeving manner, each second transmission member is connected to one end of a closed second transfer member, the other end of the closed second transfer member is connected to one second transmission member, and the second transmission member arranged at the other end of the closed second transfer member is connected to an outer periphery of a respective one-way component of the plurality of one-way components in a sleeving manner.

7. The climbing machine according to claim 6, wherein the transmission members are gears, and the closed transfer member is a chain; or the transmission members are pulleys, and the closed transfer member is a belt; or the transmission members are sheaves, and the closed transfer member is a steel rope.

8. The climbing machine according to claim 1, wherein each of the pedals comprises a foot pedal portion and a foot surface portion.

9. The climbing machine according to claim 1, wherein each one-way component of the plurality of one-way components comprises a first component and a second component coaxial with the first component, and the first component is rotatable relative to the second component in one direction and is locked relative to the second component in the opposite direction.

10. The climbing machine according to claim 1, wherein each one-way component of the plurality of one-way components is a one-way bearing, a one-way clutch or a ratchet wheel.

11. The climbing machine according to claim 1, further comprising a drive unit, wherein the drive unit comprises a motor, a reducer and a transmission assembly, one end of the transmission assembly is connected to an output shaft of the reducer, the other end is connected to the rotatable rotation shaft, and the drive unit is used for driving the rotatable rotation shaft to rotate.

12. The climbing machine according to claim 1, comprising a damping device used for reducing a rotational speed of the rotatable rotation shaft.

* * * * *